US011473405B2

(12) United States Patent
Drvar

(10) Patent No.: US 11,473,405 B2
(45) Date of Patent: Oct. 18, 2022

(54) DEVICE AND METHOD FOR PREVENTION OF FORMATION OF SEDIMENTS OF PARAFFIN AND ASPHALTENES DEPOSITS IN THE PIPELINE

(71) Applicant: Antun Drvar, Nedelisce (HR)

(72) Inventor: Antun Drvar, Nedelisce (HR)

( * ) Notice: Subject to any disclaimer, the term of this patent is extended or adjusted under 35 U.S.C. 154(b) by 134 days.

(21) Appl. No.: 16/619,164

(22) PCT Filed: Jun. 5, 2017

(86) PCT No.: PCT/IB2017/053310

§ 371 (c)(1),
(2) Date: Dec. 4, 2019

(87) PCT Pub. No.: WO2018/224857

PCT Pub. Date: Dec. 13, 2018

(65) Prior Publication Data

US 2020/0157919 A1 May 21, 2020

(51) Int. Cl.

| | |
|---|---|
| ***E21B 41/00*** | (2006.01) |
| ***C22C 9/04*** | (2006.01) |
| ***E21B 21/06*** | (2006.01) |
| ***F15D 1/00*** | (2006.01) |
| ***F17D 1/16*** | (2006.01) |
| ***E21B 43/12*** | (2006.01) |

(52) U.S. Cl.

CPC ..... *E21B 41/00* (2013.01); *C22C 9/04* (2013.01); *E21B 21/06* (2013.01); *E21B 21/063* (2013.01); *E21B 43/127* (2013.01); *F15D 1/0005* (2013.01); *F17D 1/16* (2013.01)

(58) Field of Classification Search

None

See application file for complete search history.

(56) References Cited

U.S. PATENT DOCUMENTS 3,448,034 A * 6/1969 Calvery ..... C22C 9/06 204/196.15
5,197,446 A * 3/1993 Daywait ..... B01J 19/2405 123/538
2016/0369178 A1 12/2016 Gomez

FOREIGN PATENT DOCUMENTS

WO 2016046578 A1 3/2016
WO 2016204597 A1 12/2016

OTHER PUBLICATIONS

International Preliminary Report on Patentability issued in PCT/IB2017/053310 dated May 21, 2019, 8 pages.

(Continued)

*Primary Examiner* — Adam Krupicka
(74) *Attorney, Agent, or Firm* — RatnerPrestia

(57) ABSTRACT

The device for preventing the formation of paraffin and asphaltene sediments and for the reduction of the viscosity of crude oil for use at an eruptive oil well, an oil well with pumpjack or for use at a pipeline, the stated device including six identical serially connected modules. Each module has an inlet spout and outlet spout. Crude oil under pressure passes through modules and simultaneously is in contact with different alloys. The device's elements consist of four different alloys that affect the crude oil while it passes through modules under pressure in the manner that it prevents the formation of paraffin and asphaltene deposits inside the pipeline or eruptive oil wells or oil wells with pumpjacks.

7 Claims, 13 Drawing Sheets

(56) References Cited

OTHER PUBLICATIONS

Figure 1A:
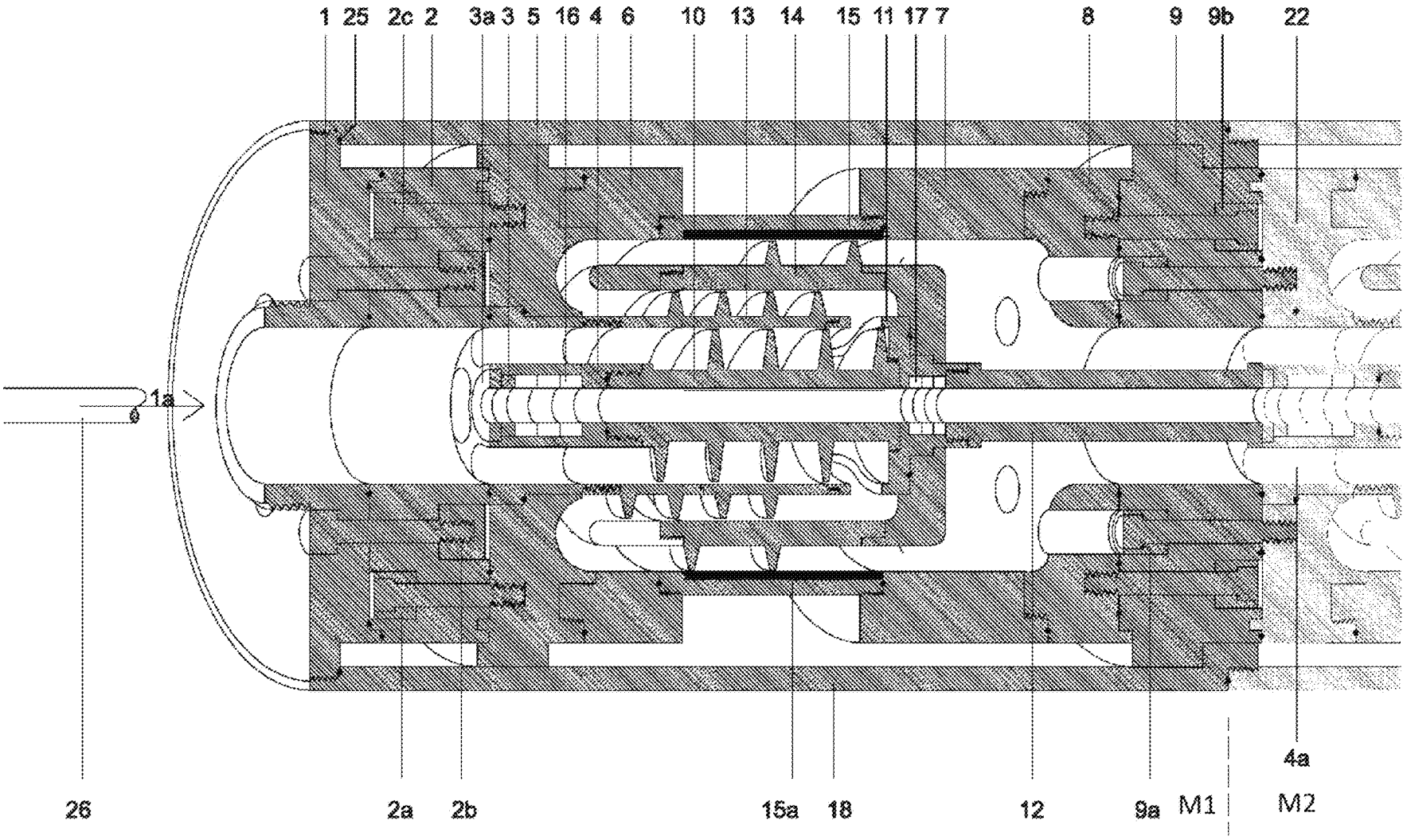

International Search Report issued in PCT/IB2017/053310, dated Feb. 26, 2018, 4 pages.
Written Opinion of the International Search Authority issued in PCT/IB2017/053310 dated Feb. 26, 2018, 10 pages.

* cited by examiner

Photomicrography – untreated crude oil

Photomicrography – treated crude oil

DEVICE AND METHOD FOR PREVENTION OF FORMATION OF SEDIMENTS OF PARAFFIN AND ASPHALTENES DEPOSITS IN THE PIPELINE

DESCRIPTION OF THE INVENTION

The Field Pertaining to the Invention

This device is intended for the treatment of crude oil, whereby the formation of paraffin sediments i.e. paraffin wax and asfaltene inside pipelines, equipment and treatment facilities is prevented by means of a device from the field of nanotechnology.

Technical Problem

Crude oil is mainly consisted of various types of hydrocarbons. Paraffins (alkanes), cycloalkanes and aromatic hydrocarbons are emphasized as the most common types of hydrocarbons in the composition of crude oil. Asfaltenes and naphthenes are also found in the composition of crude oil.

Paraffins are hydrocarbons of large molecular masses, consisting of chains of 20 or more carbon atoms. Transporting crude oil through pipelines, especially in low-temperature conditions, the paraffins found in crude oil begin to produce crystals of paraffin wax, separate and form deposits along the inner walls of the pipeline. The thickness of such a paraffin sediment increases over time and leads to a significant flow reduction, which decreases productivity and profitability. Complete pipeline obstruction occurs very frequently, and restoring the function of such a pipeline incurs large costs and causes operational difficulties. Paraffin sediments have a negative effect on the production, transport and treatment of crude oil, and as a result, cause a decrease in revenue for the manufacturer. In addition to the paraffin sediments, asfaltenes, being large and complex molecules, also form deposits on pipeline walls, and together with paraffin wax, form obstructions. These sediments and obstructions are one of the greatest problems of the global oil industry. In order to remove these obstructions, it is first necessary to detect the exact location and size of the deposit, and then find an appropriate method for removing the deposit, given the conditions. The process of detecting the location and size of the deposit is expensive in and of itself, and taking into account that such a process is carried out with the use of ultrasound or magnetic resonance, it cannot be used on submarine pipelines, which happen to be, due to their low-temperature environments, most susceptible to obstructions.

Further, all methods of removing paraffin and asfaltene deposits are not applicable in all pipelines, and therefore, it is necessary to find the most appropriate solution in the given conditions, in over to prevent even larger damage.

Sediments of paraffin and asfaltene deposits can also cause difficulties with crude oil storage tanks, oil wells, equipment (valves, pumps), treatment facilities, etc.

State of the Art

Chemical solvents are used for the removal of paraffin wax from pipelines, but have a weak effect at low temperatures. Since pipeline obstructions most often occur at low temperatures, this fact concerning chemical solvent use represents a serious deficiency. It is likewise necessary to take into account the danger of use and potential leakage of chemicals may have on the environment. Furthermore, mechanical scrapers are used, which are relatively effective but can cause physical damage. In the event of a more severe obstruction, a mechanical scraper can become lodged inside the pipeline and hence exacerbate the problem many times over.

The procedure "Targeted Heat Placement in Remote Locations" is also used, in which chemicals are pumped into the pipeline, which then create a reaction at the location of the obstruction and release heat in order to dissolve and remove the paraffin sediments. Procedures for dissolving deposits with heat are also in use, which use steam, hot oil and hot water; however, these procedures call for significant additional energy use.

However, all of the stated solutions focus on a problem that has already arisen and has already caused a drop in productivity. On the other hand, the subject invention represents a prevention process and prevents the occurrence of the problem—prevention instead of remedying damage. With the installation of the subject device at an oil well, crude oil is treated during extraction, specifically prior to entry into the pipeline for transport. Treatment with the device according to the invention causes a redistribution of crude oil molecular groups and thusly prevent paraffins and asfaltenes from separating and depositing inside the pipeline during transport. Subsequently, cleaning of the pipeline is no longer necessary and a drop in productivity due to reduced or blocked crude oil flow is prevented.

DISCLOSURE OF THE INVENTION

The primary objective of this invention is to construct a device that causes the redistribution of molecules and a change in the molecular structure of crude oil through an interaction between four alloys of differing compositions and crude oil, acting on the principle of nanotechnology, and thusly preclude the settling of paraffin wax and asfaltene onto pipeline walls in further transport. Each of the four alloys are of a different composition, and each is made of different combinations of metals, non-metals and precious metals. Their mutual interactions during contact with crude oil lead to an exclusively physical process of redistribution of molecules inside the structure of crude oil.

The secondary objective is to convert heavy and extra heavy crude oils from a non-Newtonian fluid into a stable Newtonian fluid of decreased and stable viscosity using this device, enabling its undisturbed flow through the pipeline. The viscosity of heavy and extra heavy crude oils acquires a value characteristic of light crude oils.

The following objective of this invention is the fact that this device does not provoke chemical changes in the crude oil, nor are other characteristics or qualities of the treated crude oil changed, and it is possible to execute further treatment of crude oil in treatment facilities without any difficulties. The redistribution of the particles of crude oil achieved with this treatment is retained for at least two years.

An additional objective is the production of such a device, which with its specific structure, enables conditions for the unimpeded interaction between alloys and crude oil and hence its effect on crude oil, which ultimately achieves a successful implementation of the process.

Another objective of this invention is that with this invention, the same effect is achieved during treatment of heavy fuel oils (for example bunker fuel).

An additional objective of this invention is a device that is installed at the location where crude oil exits the well and enters the pipeline, but it is possible to adapt the device for application inside the oil well (eruptive oil well or pumpjack oil well) in order to achieve the same results. Submarine installation is possible.

For the successful implementation of the process and achieving all previously described effects, the materials of which the alloys are comprised are critical, as well as the fact that the four alloy elements of the device are, according to their composition, made of different alloys, and must be integrated into the device in the manner as described hereinafter, in order to enable their mutual interaction and full contact with the crude oil that flows through the device. The materials of each individual alloy are of crucial importance, as well as their positioning inside the entire device.

The device operates on the principle of nanotechnology, and with the manipulation of molecules and their arrangement and the alteration of the molecular structure of crude oil, such crude oil assumes new physical properties.

Each alloy is made of different combinations of metals, non-metals and precious metals. The atoms of the elements of which the alloys are made have membranes, inside which their electron clouds are located. Upon contact with crude oil, each element of the alloy acts upon the crude oil in a different manner with its membrane, and the overall synergy of the effects of all elements from four different alloys results in the described effects. A portion of the energy of the alloys' elements is transferred to the crude oil molecules, and due to this, dispersion and rearrangement of the structure of the crude oil occurs. Molecule groups are differentiated according to size and are dispersed thusly, and crude oil particles then begin to glide over each other better.

The new molecular arrangement is so that paraffins no longer separate when crude oil flows through pipelines, nor are paraffin wax crystals created or deposited on the pipeline walls. Subsequently, paraffins can no longer decrease flow or create obstructions. Upon treatment, obstructions do not form at extremely low temperatures, even with types of crude oil that contain a very large amount of paraffin in its composition.

Furthermore, rearrangement of molecule groups also indicates that heavy and extra heavy crude oils, which originally behave as non-Newtonian fluids, become stable Newtonian fluids, even at low temperatures. The viscosity of treated crude oil no longer depends on the energy acting upon the crude oil or its shear rate, but remains stable and considerably lowered even at very low temperatures. The viscosity of heavy and extra heavy crude oil after treatment with the subject invention assumes values that are otherwise characteristic of the viscosity of light crude oils, i.e. the crude oil is transformed into a low viscosity fluid. Extra heavy, heavy and light crude oils are defined in accordance with API Classification.

It is necessary to consider the following as evidence of this assertion: paraffin wax crystals begin to form in regular, untreated crude oil at low temperatures, which drastically increase the viscosity of such crude oil, and the crystals separate and create obstructions in pipelines. It is a fact that upon treatment with the subject invention, the viscosity of heavy and extra heavy crude oils remained at low viscosity values, which is characteristic of light crude oils, even at low temperatures, and proves that paraffin wax crystals that would increase viscosity no longer form after treatment. Taking into account that paraffin wax crystals are no longer formed, they cannot be deposited on the pipeline walls. The accompanying examples of viscosity measurements prove the functionality of the subject invention.

Asfaltenes are another key ingredient of the sediment that blocks pipelines or reduces their flow. The influence of the subject invention is expressed on asfaltenes as well. Asfaltenes are large and complex molecules that being to overlap when found in high concentrations. This is another reason for the high viscosity of such crude oil. With the operation of the subject invention, crude oil atoms and molecules are dispersed and rearranged in the manner that prevents the overlapping of asfaltene molecules. This is another reason why the crude oil after treatment assumes the property of a Newtonian fluid and a significantly decreased and stable viscosity. As a result of this new structure, asfaltene will not be deposited on pipeline walls when crude oil flows through.

All of the stated changes are exclusively physical, and have no negative effect on the quality or quantity of the crude oil or on its further treatment in treatment facilities. The new molecular structure obtained with the use of the device accelerates the transport of crude oil through pipelines and eliminates costs for cleaning pipelines and equipment. The new structure, with all previously described novel characteristics, is retained at least two years.

IMPLEMENTATION OF THE INVENTION

Figure 1B:
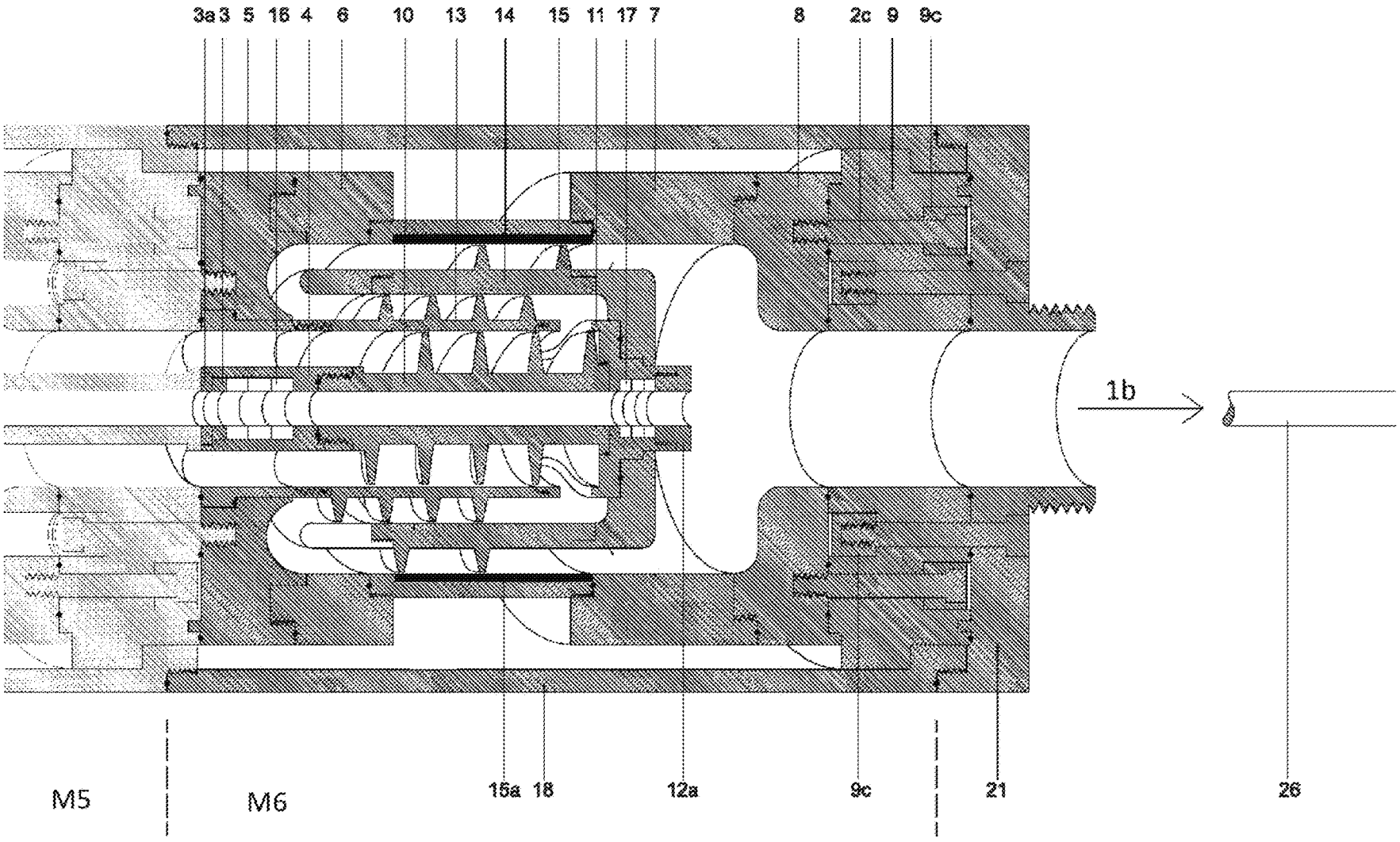
Figure 2A:
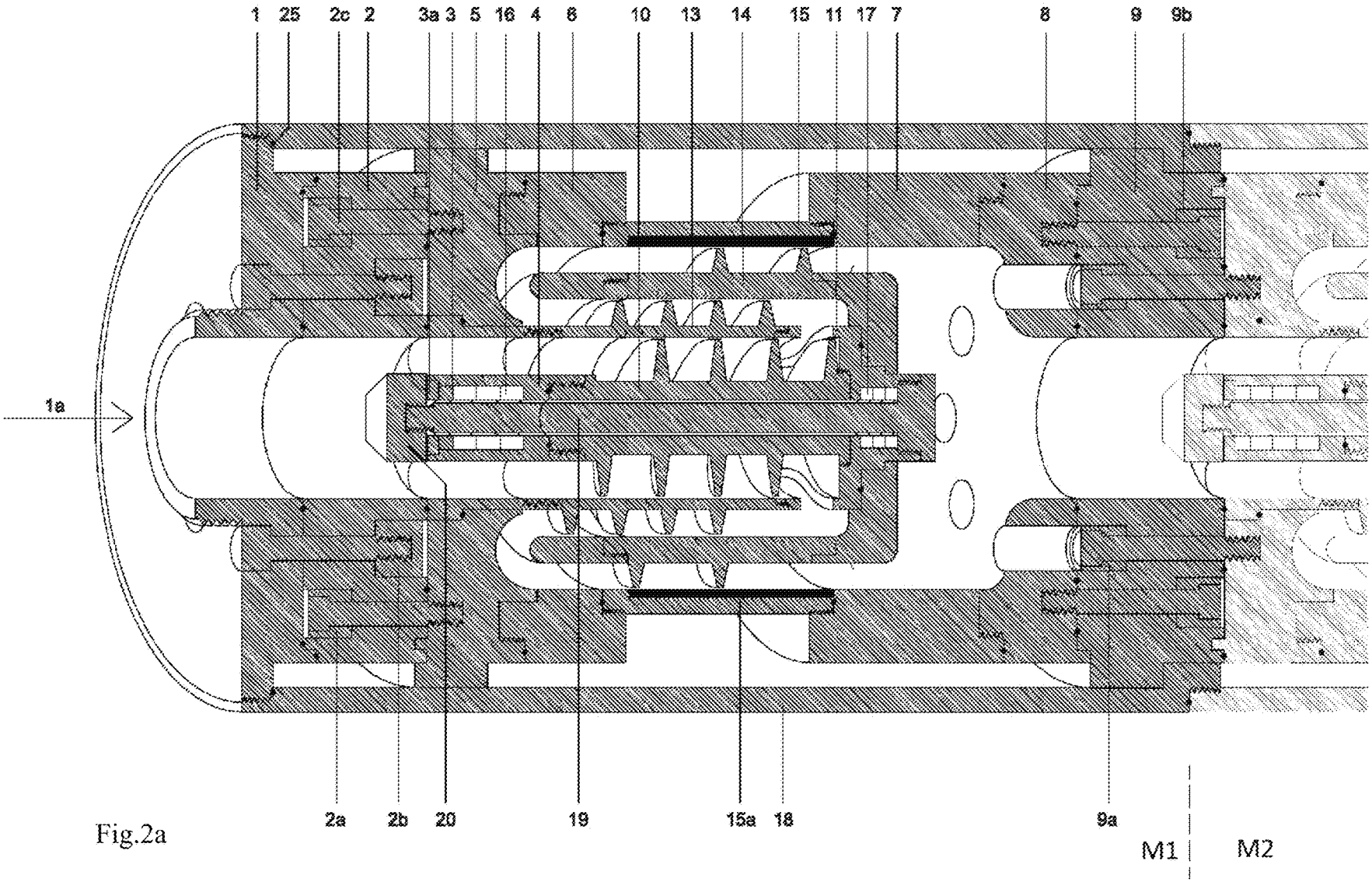
Figure 2B:
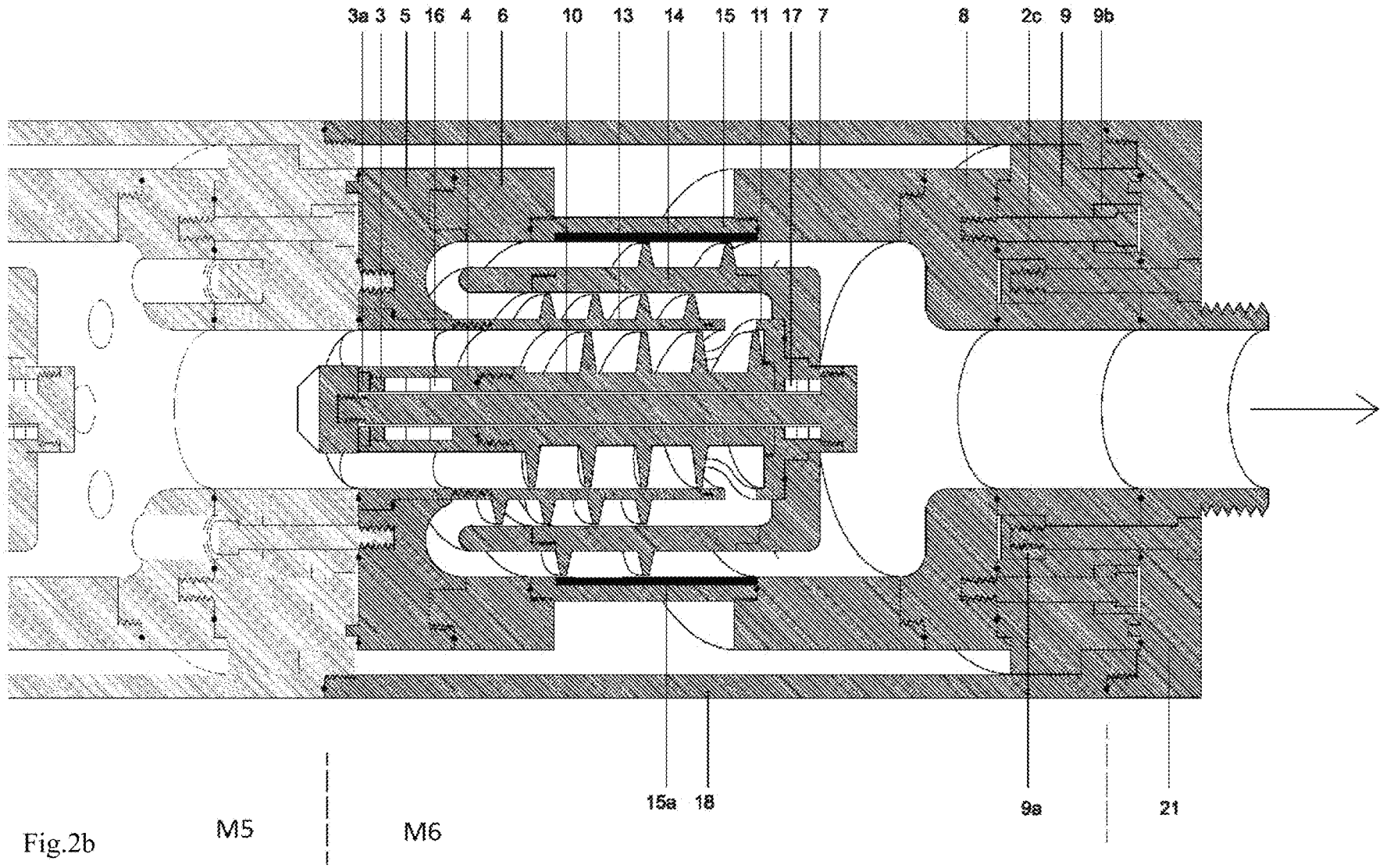
Figure 3:
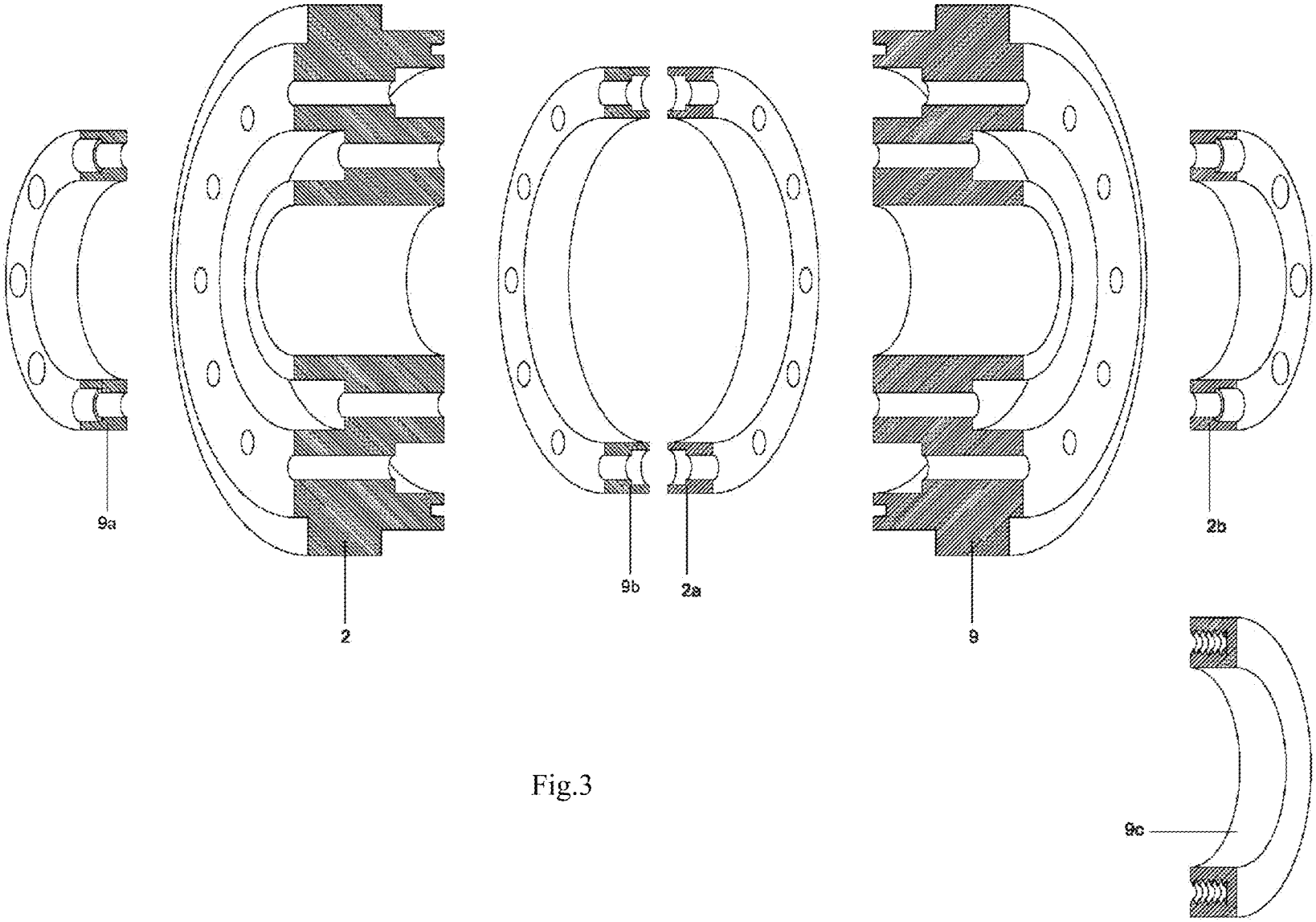
Figure 4:
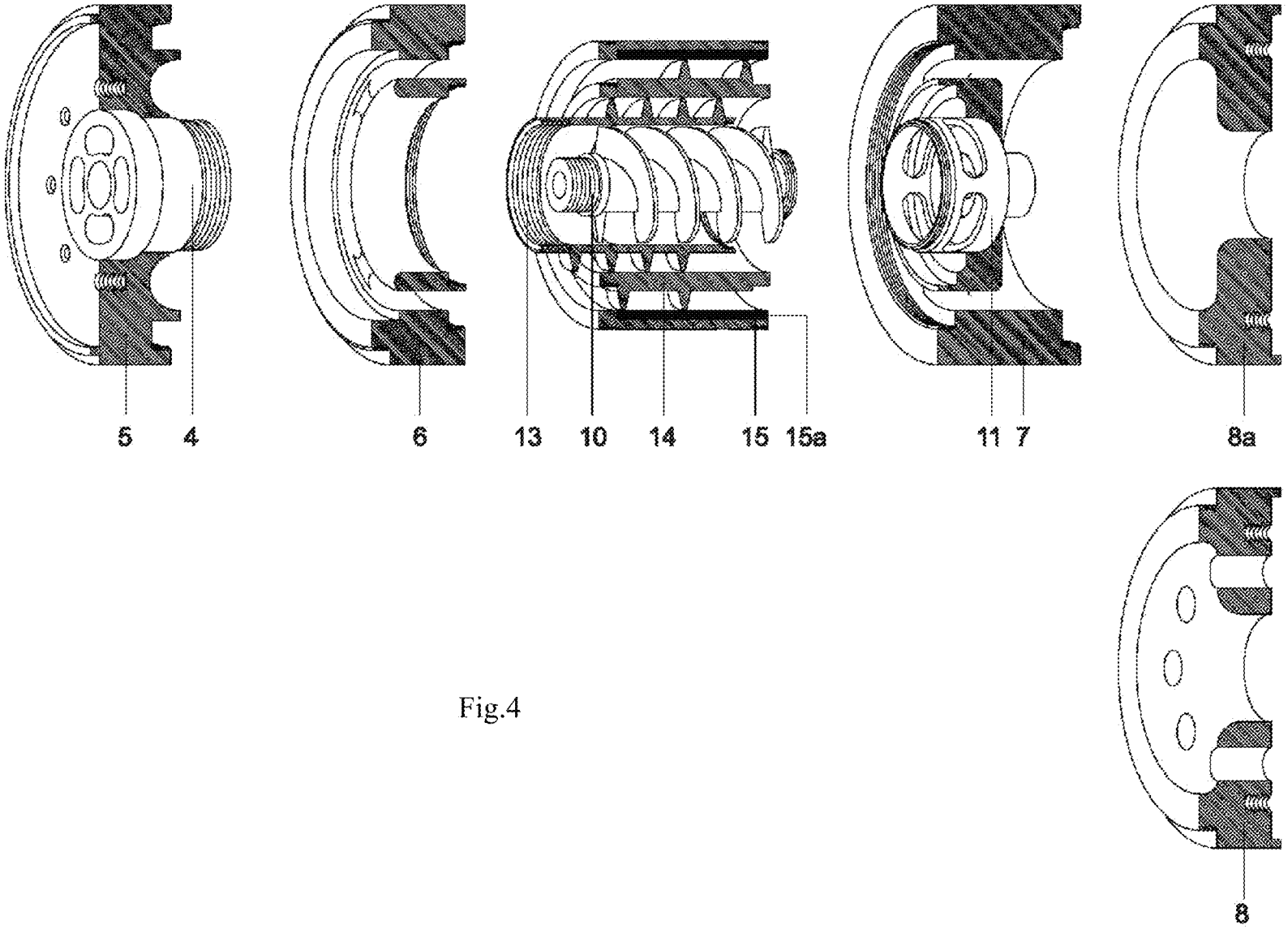
Figure 5:
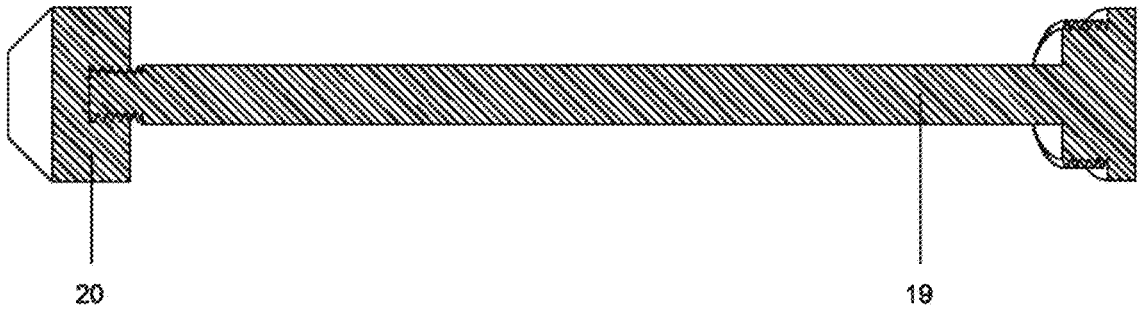
Figure 5:
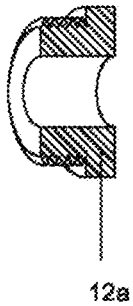
Figure 6:
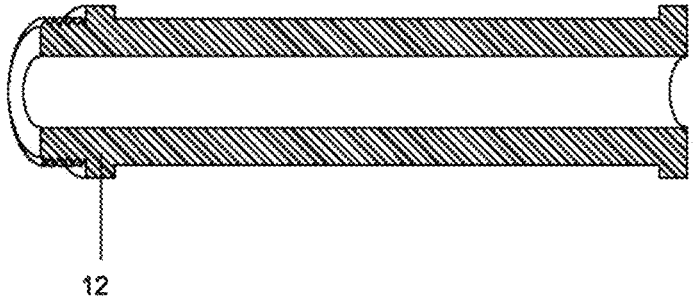
Figure 6:
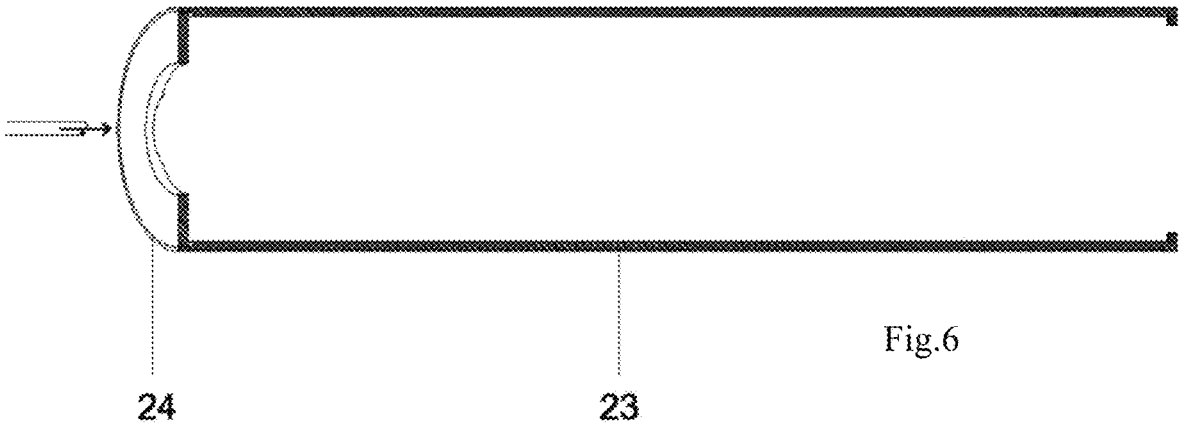
Figure 7A:
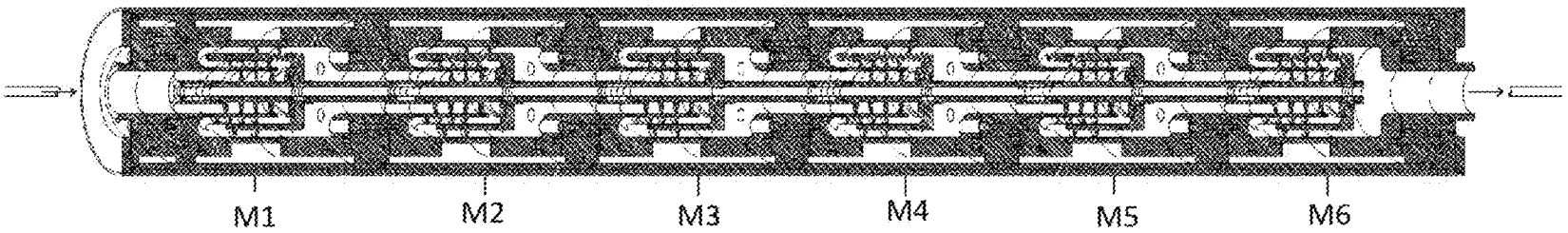
Figure 7B:
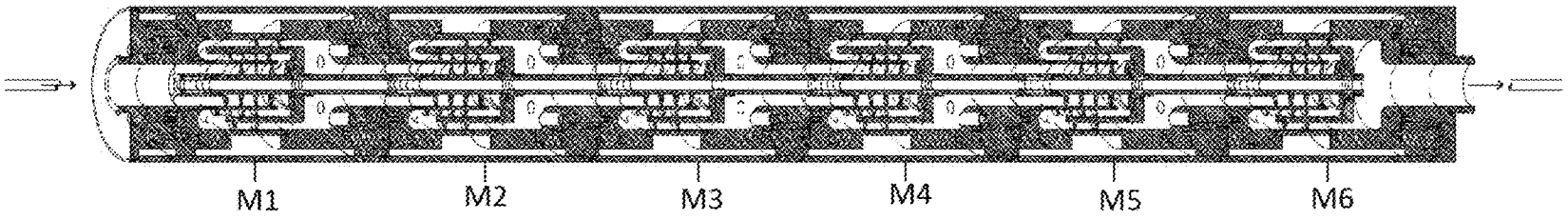
Figure 7C:
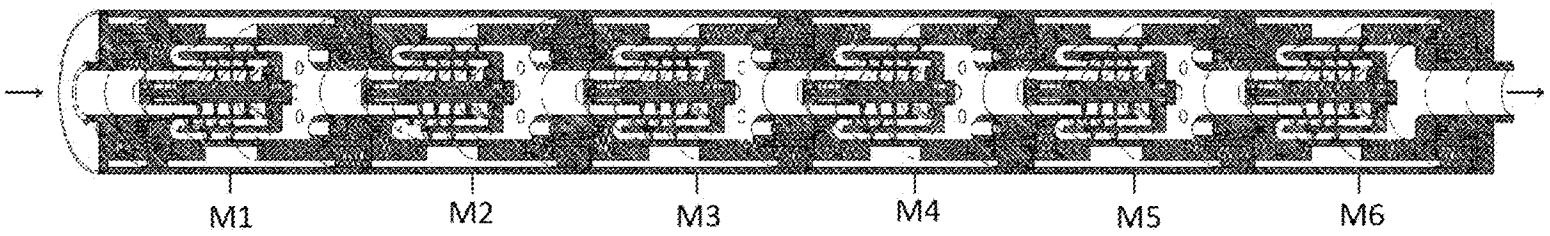
Figure 8:
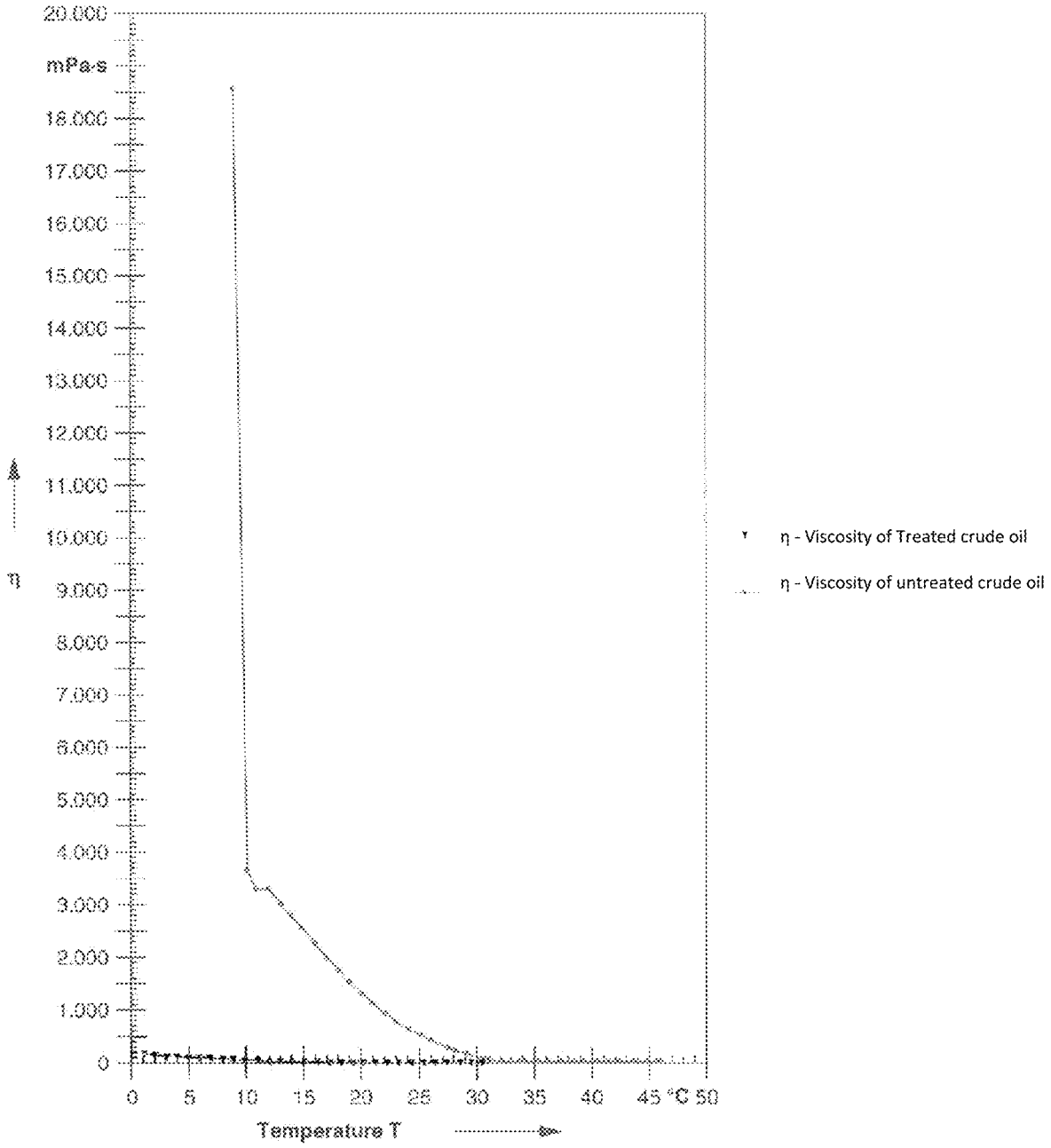
Figure 9:
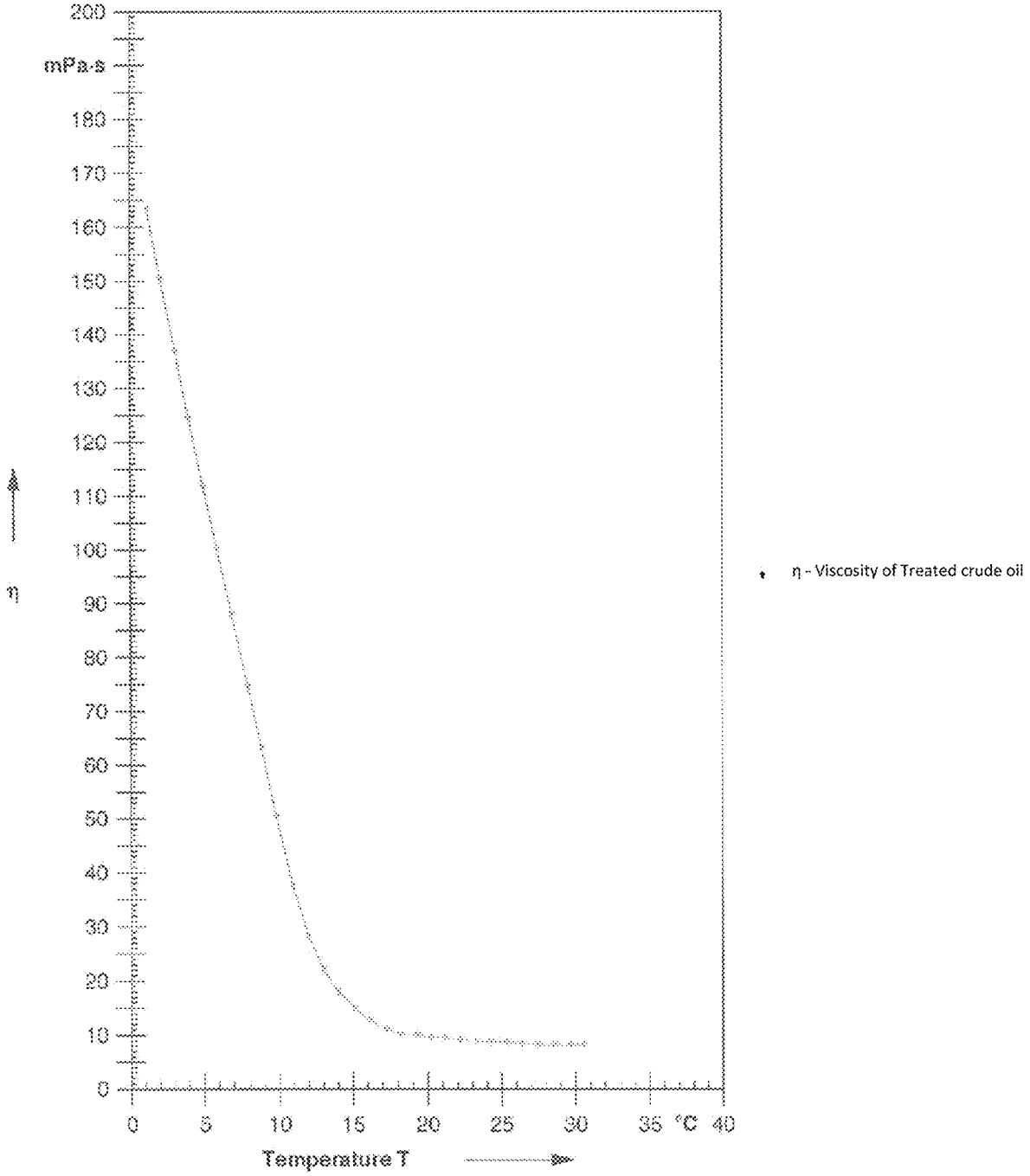
Figure 10:
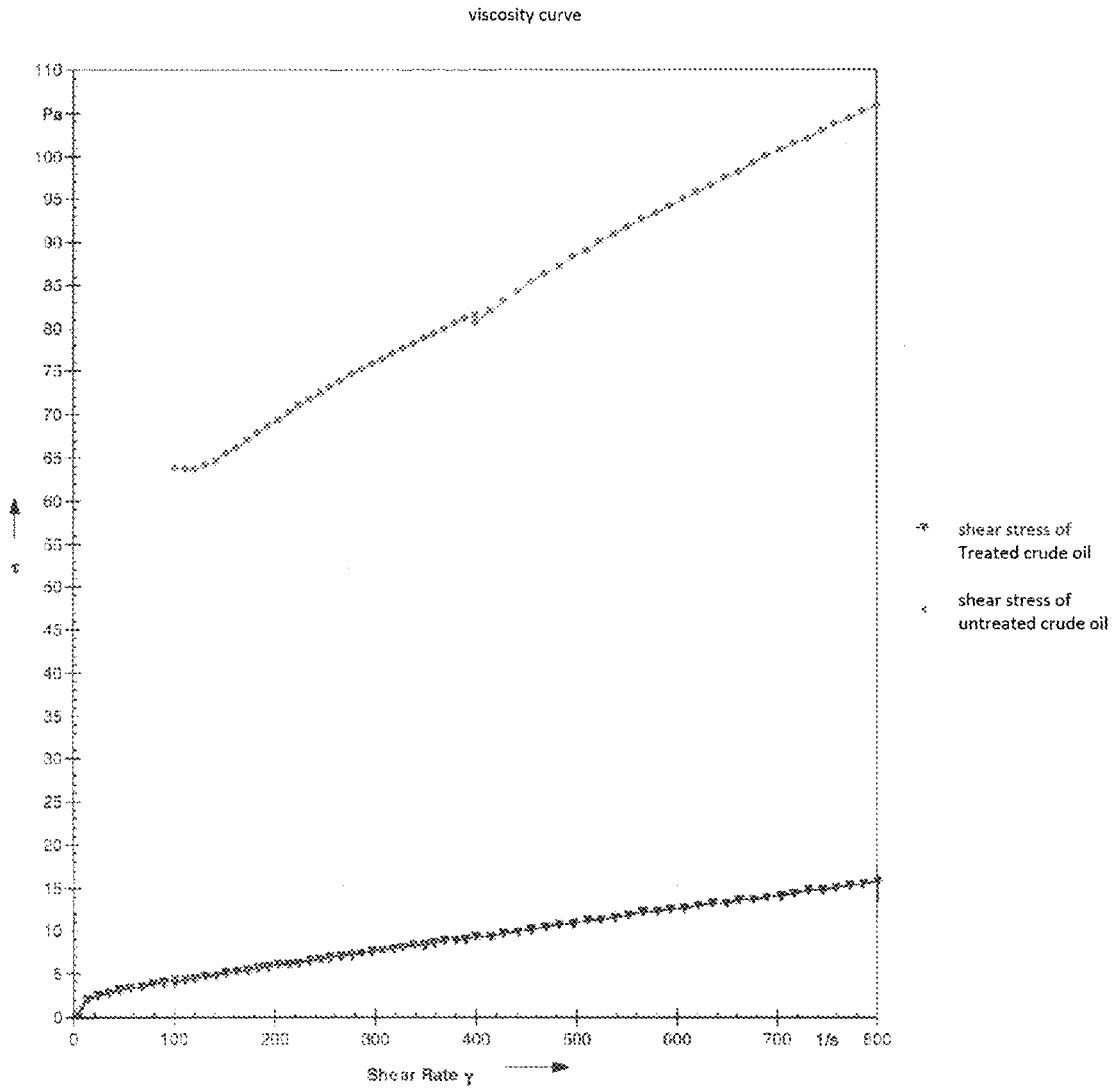
Figure 11:
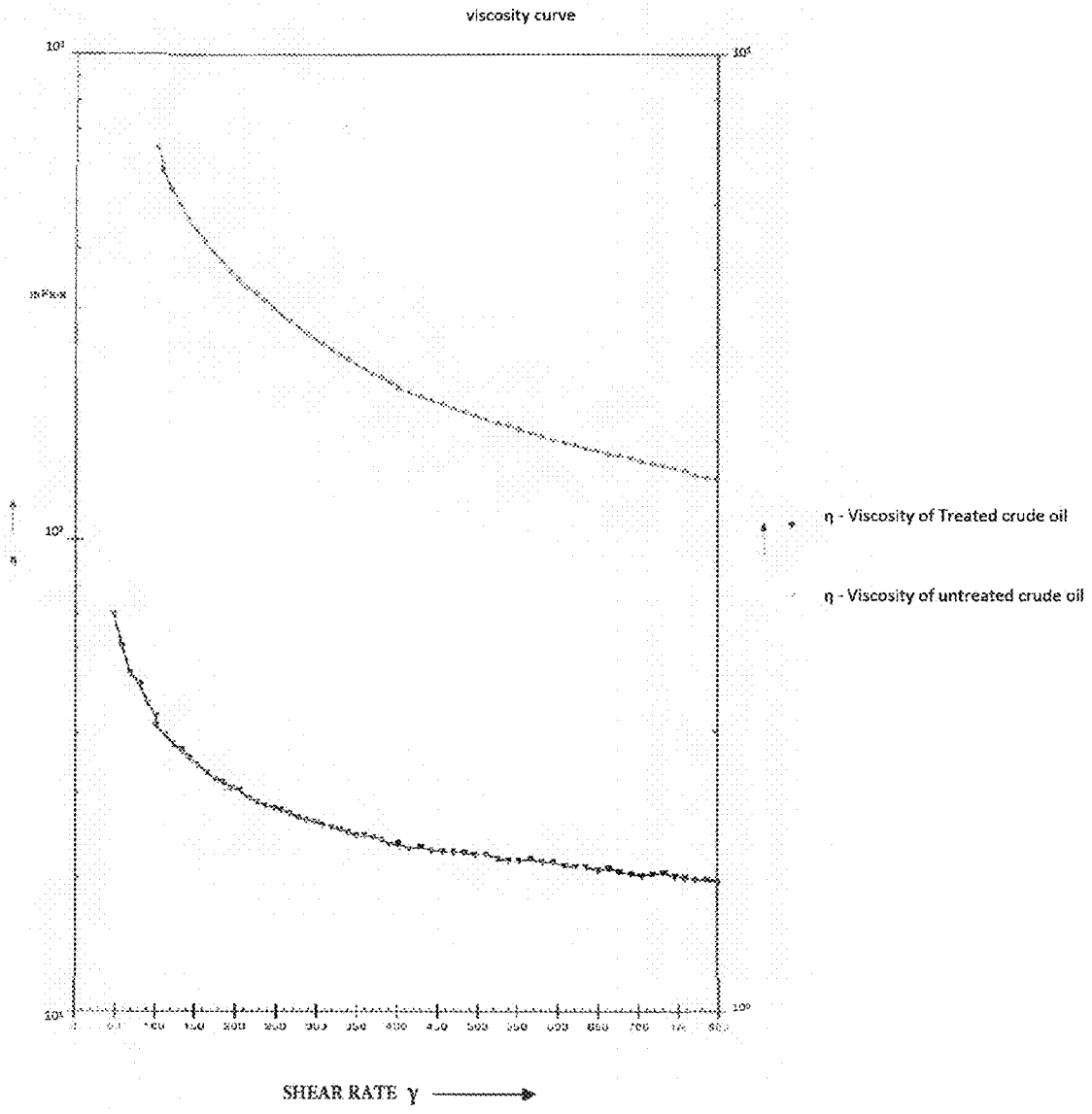
Figure 12A:
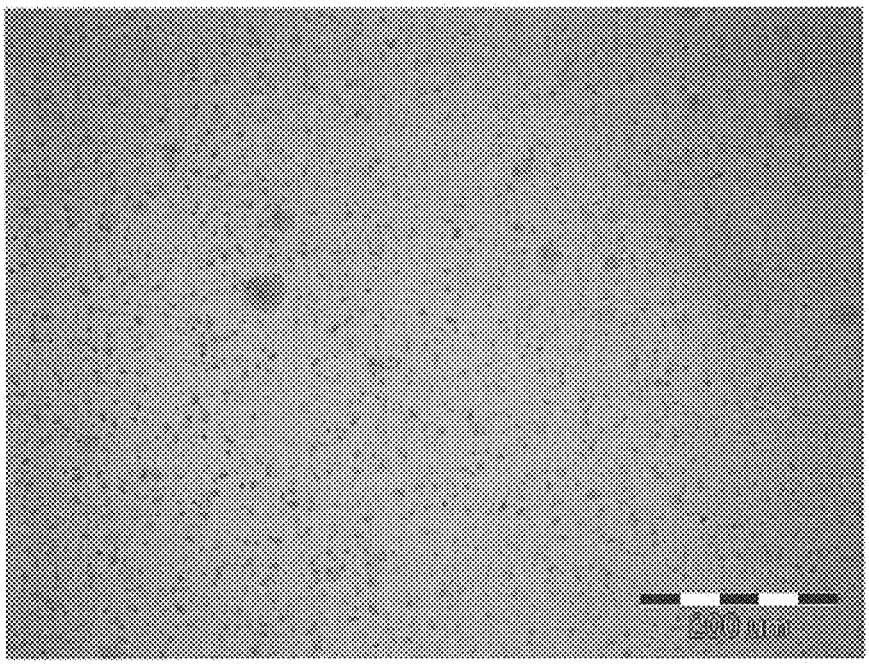
Figure 12B:
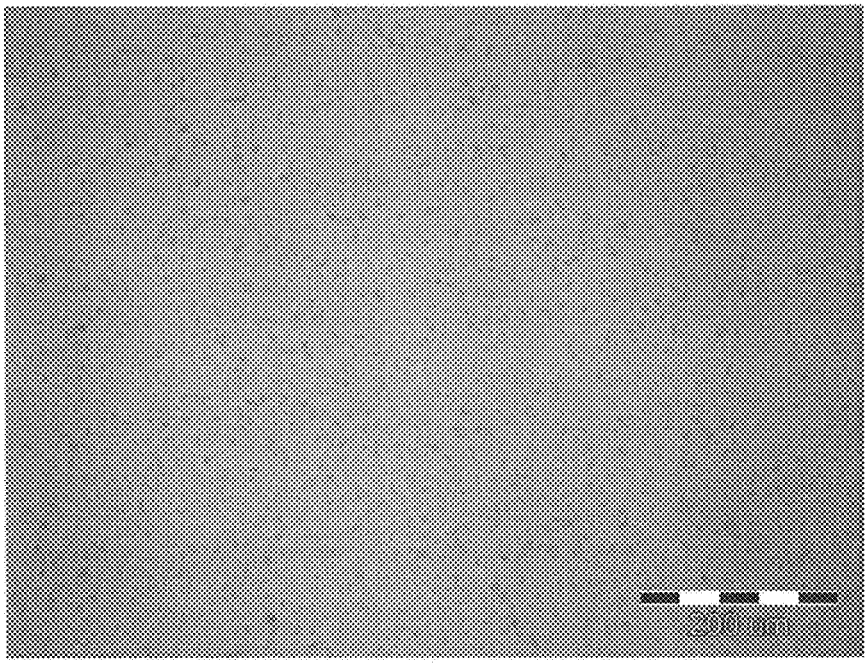

The subject invention is presented in the accompanying figures, which show:

FIG. 1*a* shows the first module connected to the second module, intended for use at a pumpjack FIG. 1*b* shows the final sixth module, intended for use at a pumpjack FIG. 2*a* shows the first module connected to the second module, intended for use at an eruptive oil well or pipeline FIG. 2*b* shows the final sixth module, intended for use at an eruptive oil well or pipeline FIG. 3 shows the cross section of the isolator with accompanying rings FIG. 4 shows the cross section of the inlet and outlet collectors and the cross sections of all alloy elements FIG. 5 shows the shielding rod, joining carrier of the first and second device and the joining carrier of the last device in the series FIG. 6 shows the main safety pipe FIG. 7*a* shows the system according to the invention with all 6 modules serially connected, intended for use at a pumpjack FIG. 7*b* shows the system according to the invention with all 6 modules serially connected, intended for use at an eruptive oil well FIG. 7*c* shows the system according to the invention with all 6 modules serially connected, intended for use at a pipeline FIG. 8 shows the graphical representation of viscosity for samples of untreated crude oil and treated crude oil FIG. 9 shows the enlarged graphical representation of viscosity for samples of crude oil treated using the device according to the subject invention FIG. 10 shows the graphical representation of viscosity (shear stress-shear rate) of samples of untreated crude oil and treated crude oil FIG. 11 shows the graphical representation of viscosity (dynamic viscosity-shear rate) for samples of untreated crude oil and treated crude oil FIG. 12*a* shows the micrograph of a sample of untreated crude oil FIG. 12*b* shows the micrograph of a sample of crude oil treated with a device according to the subject invention.

The device is designed so that it can be applied at eruptive oil wells, at oil wells with pumpjacks and on land and submarine pipelines without any alternations.

The subject invention is implemented with the construction of a device that prevents the deposit of paraffin and asfaltene sediments, and reduces the viscosity of crude oil for use at eruptive oil wells, at oil wells with pumpjacks or for use on pipelines, and the stated device consists of 6 identical modules (M1), (M2), (M3), (M4), (M5), (M6), which are jointly connected in series. Each module (M1), (M2), (M3), (M4), (M5), (M6) consists of an inlet opening (1*a*) and outlet opening (1*b*) for the entry and exit of crude oil, and crude oil under pressure passes through the device between the first alloy element (10) and the second alloy elements (13), and simultaneously comes into contact with both stated alloys. Then the crude oil enters a passage made by the second alloy element (13) and the third alloy element (14), and comes into contact with the outside spiral of the second alloy element (13) and the inside of the third alloy element (14), and then continues passing through the device through a passage made by the third alloy element (14) and the fourth alloy element (15*a*), which is situated inside a pipe (15), and as crude oil passes through, it comes into contact with the outside of the third alloy element (14) and the inside of the fourth alloy element (15*a*), whereby the elements of the device (10), (13), (14), (15*a*) are made of four different alloys.

Compositions of the stated alloys for elements (10), (13), (14), (15*a*) are stated as follows:

| ELEMENT | ALLOY 1 (10) | ALLOY 2 (13) | ALLOY 3 (14) | ALLOY 4 (15a) |
|---|---|---|---|---|
| Copper - Cu (w/w) | | 55 to 65% | | |
| Zinc - Zn (w/w) | | 16 to 22% | | |
| Lead - Pb (w/w) | 3.30% | 3.80% | 3.00% | 3.00% |
| Tin - Sn (w/w) | 3.60% | 3.60% | 3.60% | 3.60% |
| Manganese - Mn (w/w) | 0.25% | 0.25% | 0.25% | 0.25% |
| Iron - Fe (w/w) | 0.20% | 0.20% | 0.20% | 0.20% |
| Silicon - Si (w/w) | 0.70% | 0.50% | 0.50% | 0.20% |
| Antimony - Sb (w/w) | 0.40% | 0.38% | 0.36% | 0.36% |
| Aluminium - Al (w/w) | 3.00% | 2.50% | 2.00% | 1.50% |
| Gold - Au (w/w) | 2.10% | 2.20% | 2.30% | 2.40% |
| Silver - Ag (w/w) | 2.00% | 1.50% | 1.30% | 1.10% |
| Platinum - Pt (w/w) | 1.47% | 1.19% | 1.60% | 1.10% |
| Chromium - Cr (w/w) | 0.60% | 0.40% | 0.40% | 0.40% |
| Nickel - Ni (w/w) | 1.50% | 2.80% | 3.00% | 1.40% |
| Cobalt - Co (w/w) | 0.60% | 1.40% | 1.30% | 1.00% |
| Tungsten - W (w/w) | 0.40% | 1.40% | 1.30% | 0.60% |

The optimal compositions of alloys for the elements of the device (10), (13), (14), (15*a*) are:

| ELEMENT | ALLOY 1 (10) | ALLOY 2 (13) | ALLOY 3 (14) | ALLOY 4 (15a) |
|---|---|---|---|---|
| Copper - Cu (w/w) | 57.88% | 58.88% | 62.89% | 63.89% |
| Zinc - Zn (w/w) | 22.00% | 19.00% | 16.00% | 19.00% |
| Lead - Pb (w/w) | 3.30% | 3.80% | 3.00% | 3.00% |
| Tin - Sn (w/w) | 3.60% | 3.60% | 3.60% | 3.60% |
| Manganese - Mn (w/w) | 0.25% | 0.25% | 0.25% | 0.25% |
| Iron - Fe (w/w) | 0.20% | 0.20% | 0.20% | 0.20% |
| Silicon - Si (w/w) | 0.70% | 0.50% | 0.50% | 0.20% |
| Antimony - Sb (w/w) | 0.40% | 0.38% | 0.36% | 0.36% |
| Aluminium - Al (w/w) | 3.00% | 2.50% | 2.00% | 1.50% |
| Gold - Au (w/w) | 2.10% | 2.20% | 2.30% | 2.40% |
| Silver - Ag (w/w) | 2.00% | 1.50% | 1.30% | 1.10% |
| Platinum - Pt (w/w) | 1.47% | 1.19% | 1.60% | 1.10% |
| Chromium - Cr (w/w) | 0.60% | 0.40% | 0.40% | 0.40% |
| Nickel - Ni (w/w) | 1.50% | 2.80% | 3.00% | 1.40% |
| Cobalt - Co (w/w) | 0.60% | 1.40% | 1.30% | 1.00% |
| Tungsten - W (w/w) | 0.40% | 1.40% | 1.30% | 0.60% |
| | 100.00% | 100.00% | 100.00% | 100.00% |

Preferred Manner of Assembly of the Device

The device is designed so that it can be used at eruptive oil wells, at oil wells with pumpjacks and for external use on pipelines.

Installation of the device at an oil well with a pumpjack begins with the assembly of the first module (M1) and is carried out as follows:

Inside a ceramic carrier (4) bands (16) are installed, which are sealed with a ceramic ring (3) and a safety hoop (3*a*). Then the ceramic carrier (4) is fastened in the left part of the inlet collector (5). On the left part of the collector (5), a ceramic coupler (2) is then installed, which is fastened onto the left part of the collector (5) using a ring (2*a*) and 12 screws (2*c*). Next, the module carrier (1), which has an inlet spout (1*a*) of a size appropriate to the tubing, is fastened on the ceramic coupler (2) using 8 screws in the inner metal ring (2*b*) with 8 bores, which is situated in the mentioned ceramic coupler (2). The ceramic coupler (2) also assumes the role of an input isolator. The ceramic carrier (4), which is screwed onto the left part of the collector (5), has fastened to it the first alloy element (10), and then the second alloy element (13), then follows the input carrier of the first alloy element (11), which is screwed onto the second alloy element (13).

Next, the right part of the inlet collector (6) is secured onto the left part of the inlet collector (5), upon which the third alloy element (14) is screwed on the right part of the collector (6), and then a pipe (15) is screwed into the right part of the collector (6), whereby the pipe (15) connects the right part of the inlet collector (6) and the left part of the outlet collector (7). The left part of the outlet collector (7) is then screwed on the pipe (15), which connects the collector (6) and the collector (7).

The inside of the pipe (15) has an additional alloy element (15*a*) inserted, in the shape of the pipe. The joining carrier (12) of the first and second module is secured onto the ceramic carrier (11) of the first alloy element (10).

The ceramic coupling (9) is secured onto the right part of the outlet collector (8), via an outer metal ring (9*b*) with 12 bores. The ceramic coupling (9) also assumes the function of an isolator. In the collector (22) of the next module (M2), the ceramic carrier (4*a*) of the next module is screwed on (identical to the ceramic carrier (4) which is equipped with three bands that are identical to the three bands (16)). The collector (22) of the next module is screwed onto the ceramic coupling (9), with 8 screws on the inner ring (9*a*).

Then the right part of the outlet collector (8), on which elements (22) and (4*a*) are secured with screws, is screwed onto the left part of the outlet collector (7). The first safety pipe with a cog (18) is installed using the ceramic coupling (9), which is then secured onto the module carrier (1). Modules (M1), (M2), (M3), (M4), (M5), (M6) are serially connected thusly, a total of 6 modules, depending on the type of crude oil being treated. Each module in the series is assembled in the previously described manner.

The right part of the outlet collector (8*a*) of the last module (M6) in the series differs from the other modules by not having through holes for securing screws. The last module (M6) in the series ends with the module carrier (21), which is screwed onto the first safety pipe (18). When the carrier (21) is connected to the pipe (18), that assembly (21+18) is additionally fastened to the rest of the device with 8 screws (2*c*) in the end ring (9*c*) situated in the isolator (9) of the last module. The ring (9*c*) is only characteristic of the last module. The ceramic coupling (12*a*), unique only to the last module, and as an end ceramic coupling, is shorter and contains a thread. The central part of the carrier (21) has an outlet connection (1*b*) for tubing. The outlet connection for tubing must be of a size appropriate to the tubing. All connections of each individual module are sealed with an O-ring (25).

When installation is complete and all 6 modules (M1), (M2), (M3), (M4), (M5), (M6) are serially connected, the main safety pipe (23), which serves as additional protection and insulation, is pulled over the 6 modules. The main safety pipe (23) has a helical thread at its entry on which an entry lid (24) is fastened, and has a cog at its exit. The device is designed so that it can be lowered into all oil wells, at the greatest possible depths.

The first alloy element (10) of each module is passable, i.e. a passable canal extends through its center. The canal is intended for a pumpjack piston pump (26) so that the device can be installed at an oil well with a pumpjack. The canal is a suitable diameter for a piston size of 25.4 mm. For preparation of the device for use at an eruptive oil well and a pipeline, it is necessary to remove the joining carriers (12) of the next module, and then the first alloy element (10) is shielded with a rod (19), which is tightened with bolts (20). The first alloy element of each following module in series must be shielded in the described manner.

Each alloy element is 250 mm in length. Each module in series is approximately 610 mm in length. A series of 6 modules is preferably approximately 3660 mm in length, and between 380 mm and 410 mm in width. The stated measurements are approximate and can be changed in accordance with the dimensions of an oil well and the flow rates and pressures that must be fulfilled.

The first alloy (10) is shaped in the manner that is has two right-handed spirals on its outside, offset from one another at 180°. At the length of 250 mm, each spiral makes one 360° revolution of its spiral. The central part of the alloy (10) is hollow, and of a diameter of 25.4 mm. The stated cavity is intended for shielding the device with a rod (19) when repurposing the device for operation at an eruptive oil well or pipeline. The height of the spiral element of the first alloy is preferably 34 mm.

The second alloy element (13) also has two spirals on its outside, which are offset from one another at 180°. At the length of 250 mm, each spiral makes one 360° revolution of its spiral. The spirals of the element (13) are left-handed, and their height is preferably 16 mm. The inside surface of the alloy element (13) is straight. The inside diameter of the second alloy element (13) is in size equal to the outside diameter of the first alloy element (10).

The third alloy (14) also has two right-handed spirals on its outside, offset from one another at 180°, and at the length of 250 mm, each spiral makes one circular revolution. The inside diameter of the alloy (14) is in size equal to the outside diameter of the alloy (13). The height of the spiral of the third alloy element is preferably 12 mm.

The fourth alloy (15*a*) is situated inside the pipe (15). The fourth alloy is pipe-shaped, has a coarse surface, and has no spirals.

The alloys are situated in the manner that crude oil passing through the device passes between the first alloy element (10) and second alloy element (13), and simultaneously is in contact with both stated alloys. After that, the crude oil travels further through the device, and passes through a passage formed by the second alloy element (13) and the third alloy element (14). During that passage, the crude oil is in contact with the outside spiral of the second alloy element (13) and the inside of the third alloy element (14). The crude oil then continues its passage through the device and passes through a passage formed by the third alloy element (14) and the fourth alloy element situated inside the pipe (15). During that passage, the crude oil is in contact with the outside of the third alloy element (14) and the inside of the fourth alloy element (15*a*). This manner of crude oil passing through the device ensures that the crude oil is simultaneously in contact with two different alloys at every moment, by which the previously described structural changes are achieved. In the described manner, the crude oil passes through each of the 6 serially-connected identical modules (M1), (M2), (M3), (M4), (M5), (M6) of the device.

Each of the 6 serially-connected modules (M1), (M2), (M3), (M4), (M5), (M6), has an input (2) and output isolator (9). Isolators (2) and (9) serve to isolate each individual module from the other modules in the series. In that manner, each module (M1), (M2), (M3), (M4), (M5), (M6) conducts the crude oil treatment separately, without impact from other modules or external conditions.

TESTING EXAMPLES

Samples of crude oil and crude oil treated with the device according to the subject invention have been sampled. The following tests have been conducted:

1. Determining the rheological properties of crude oil—rotational viscosimetry: Method of manufacturer Anton Paar
2. Determining the rheological properties of crude oil—rotational viscosimetry (viscosity curve): Method of manufacturer Anton Paar
3. Microscopic photography of samples—photographing samples in blue fluorescent light (A=470 nm) at magnification of 200× with an Olympus BX51 microscope Interpretation of the Results:

From the viscosity curve (FIGS. 8-12), the rheological properties of crude oil as a function of viscosity to temperature at a constant shear rate and dynamic conditions of cooling samples of untreated crude oil and treated crude oil are visible. The viscosity curve on FIG. 10 shows the function of shear stress to shear rate at a constant temperature for samples of untreated crude oil and treated crude oil. FIG. 11 shows the function of dynamic viscosity to the shear rate at a constant temperature for samples of untreated crude oil and treated crude oil. According to photomicrographs, it can be noted that accumulations of asfaltenes are lower with treated crude oil in respect to untreated crude oil, and therefore, it can be assumed that the total content of asfaltenes is significantly lower.

The device according to the subject invention does not require any power supply, it does not have to be connected to a power source nor is any fuel required for operation. The estimated lifetime of the device in normal exploitation conditions is 10 years.

When crude oil enters the device, the temperature of the crude oil must be at least 50° C. The highest possible crude oil temperature and pressure at entry into the device is preferable. The device can be adapted to various pressures of operation.

It is possible to produce the device in all sizes. It is also possible to adjust the device to any type or amount of crude oil that is necessary to process.

Taking into account that the problem of paraffin wax and asfaltene sediments are most evident in submarine pipelines due to very low temperatures, the subject invention is especially recommended for installation at oil wells from which crude oil is extracted and transported under water (for example oil platforms), so that the problem of forming deposits can be prevented at the crude oil extraction process itself.

The device is hermetically closed and is possible to install at submarine pipelines.

The described device for preventing the formation of paraffin and asfaltene sediments, and the reduction of viscosity of crude oil for use at an eruptive oil well, at an oil well with a pumpjack, or for use at a pipeline, offers a unique device that can achieve considerable cost savings during the extraction and transport of crude oil treated thusly. Experts will find it obvious that it is possible to make numerous modifications and changes to this device according to this invention without abandoning the scope and essence of the invention.

LIST OF REFERENCED DESIGNATIONS

1—module carrier
1*a*—inlet spout of first module
1*b*—outlet spout of sixth module
2—ceramic coupler, also input isolator
2*a*—outer metal ring with 12 holes
2*b*—inner metal ring with 8 holes
2*c*—screw
3—ceramic ring
3*a*—safety hoop
4—ceramic carrier
4*a*—ceramic carrier of next module in series
5—left part of inlet collector
6—right part of inlet collector
7—left part of outlet collector
8—right part of outlet collector
8*a*—right part of outlet collector of last module in series
9—ceramic coupling, also output isolator
9*a*—inner metal ring with 8 holes
9*b*—outer metal ring with 12 holes
9*c*—end ring of last module
10—first alloy element
11—ceramic carrier of first alloy
12—joining carrier of next module in series, used with pumpjacks
12*a*—end ceramic coupling of last module
13—second alloy element
14—third alloy element
15—pipe into which fourth alloy is inserted
15*a*—fourth alloy element
16—three input bands
17—three output bands
18—first safety pipe
19—rod for closing the passage way of the first alloy element during use at a pipeline
20—bolt of protective rod (19)
21—end carrier of last module
22—left inlet collector of next module in series
23—main safety pipe
24—entry lid of main safety pipe
25—O-ring
26—pumpjack piston pump
M1—first module in series
M2—second module in series
M3—third module in series
M4—fourth module in series
M5—fifth module in series
M6—sixth module in series

The invention claimed is:

1. A device for preventing a formation of paraffin and asfaltene sediments, and for reduction of a viscosity of crude oil, said device comprising:

six identical modules, all mutually serially connected with bolts, said modules intended for passage of crude oil, at least six serially connected modules is necessary to achieve an intended function of a device, each module comprising:

an inlet spout and an outlet spout for entry and exit of crude oil that form a through passage;

wherein, inside of the passage and between the inlet spout and the outlet spout are four centrally located elements made of different alloys comprising a first alloy element, a second alloy element, a third alloy element, and a fourth alloy element, said alloy elements connected with a ceramic carrier of the first alloy element and the ceramic carrier; the second alloy element is connected with the ceramic carrier; the third alloy element is connected with the outer part of the ceramic carrier, and the fourth alloy element is embedded into a pipe;

said alloy elements are mutually spaced apart leaving a space for passage of crude oil through:

a) a narrow passage between coils of the first alloy element and inside of the second alloy element, the coils of first alloy element allow mixing of the crude oil under high pressure and thorough contact with the walls of both corresponding alloy elements;

b) a narrow passage between coils of the second alloy element and inside of the third alloy element, the coils of second alloy element allow mixing of the crude oil under high pressure and thorough contact with the walls of both corresponding alloy elements;

c) a narrow passage between coils of the third alloy element and inside of the fourth alloy element embedded within the pipe, wherein the coils of the third alloy element allow mixing of the crude oil under high pressure and thorough contact with the walls of both corresponding alloy elements;

the outlet spout of the corresponding module is connected with the inlet spout of the next module in series and passage is completed with the outlet spout of last module, wherein pressurized crude oil passes through each of the 6 modules whereby said device's elements are composed of four different alloys wherein the composition of the first alloy element, the second alloy element, the third alloy element and the fourth alloy element are listed as follows:

| ELEMENT | ALLOY 1 | ALLOY 2 | ALLOY 3 | ALLOY 4 |
|---|---|---|---|---|
| Copper - Cu (w/w) | 57.88% | 58.88% | 62.89% | 63.89% |
| Zinc - Zn (w/w) | 22.00% | 19.00% | 16.00% | 19.00% |
| Lead - Pb (w/w) | 3.30% | 3.80% | 3.00% | 3.00% |
| Tin - Sn (w/w) | 3.60% | 3.60% | 3.60% | 3.60% |
| Manganese - Mn (w/w) | 0.25% | 0.25% | 0.25% | 0.25% |
| Iron - Fe (w/w) | 0.20% | 0.20% | 0.20% | 0.20% |
| Silicon - Si (w/w) | 0.70% | 0.50% | 0.50% | 0.20% |
| Antimony - Sb (w/w) | 0.40% | 0.38% | 0.36% | 0.36% |
| Aluminium - Al (w/w) | 3.00% | 2.50% | 2.00% | 1.50% |

-continued

| ELEMENT | ALLOY 1 | ALLOY 2 | ALLOY 3 | ALLOY 4 |
|---|---|---|---|---|
| Gold - Au (w/w) | 2.10% | 2.20% | 2.30% | 2.40% |
| Silver - Ag (w/w) | 2.00% | 1.50% | 1.30% | 1.10% |
| Platinum - Pt (w/w) | 1.47% | 1.19% | 1.60% | 1.10% |
| Chromium - Cr (w/w) | 0.60% | 0.40% | 0.40% | 0.40% |
| Nickel - Ni (w/w) | 1.50% | 2.80% | 3.00% | 1.40% |
| Cobalt - Co (w/w) | 0.60% | 1.40% | 1.30% | 1.00% |
| Tungsten - W (w/w) | 0.40% | 1.40% | 1.30% | 0.60%. |

2. The device according to claim 1 wherein the first alloy element is shaped in a manner such that it has two right-handed spirals on its outside, which are rotated in respect to each other at 180°, and at a length of 250 mm, each spiral makes one 360° revolution of its spiral, while a central part of the first alloy element has a passage way with an appropriately sized diameter, for blocking of the device with a protective rod due to multifunctional use of the device for operation at either an eruptive oil well ora pipeline.

3. The device according to claim 1 wherein the second alloy element also has two left-handed spirals on its outside, which are rotated in respect to each other at 180°, and at the length of 250 mm, each spiral makes one 360° revolution of its spiral, and the inside surface of the second alloy element is flat, while the inner diameter of the alloy element is dimensionally equal to the outer diameter of the first alloy element.

4. The device according to claim 1 wherein the third alloy element also has two right-handed spirals on its outside, rotated in respect to each other at 180°, and at the length of 250 mm, each spiral makes one circular rotation, and the inner diameter of the third alloy element is equal in size to the outer diameter of the second alloy element.

5. The device according to claim 1, wherein the element made of the fourth alloy is of cylindrical form, located inside the pipe, and with its outer surface abuts the inner surface of the pipe, the fourth alloy element has a rough inner cylindrical surface and has no spirals.

6. The device according to claim 1 wherein the device is capable of functioning in an oil well with pumpjacks such that a protective rod can be used to close an opening for a passage in a pumpjack piston pump.

7. Use of the device according to claim 1 for preventing formation of paraffin and asfaltene sediments on internal edges of a pipeline, by installing said device directly within a main pipe of an eruptive oil well or embedded within a pipe of an underwater pipeline or land pipeline where pumped oil under pressure flows through the device.

* * * * *